United States Patent [19]

Mayer

[11] Patent Number: 4,521,095

[45] Date of Patent: Jun. 4, 1985

[54] ELECTROPHOTOGRAPHIC COPYING APPARATUS INCLUDING SPECIFIC TONER FUSING ROLL AND ITS METHOD OF USE

[75] Inventor: Edward F. Mayer, San Jose, Calif.

[73] Assignee: Ricoh Company, Ltd., Tokyo, Japan

[21] Appl. No.: 529,122

[22] Filed: Sep. 2, 1983

[51] Int. Cl.[3] ..... G03G 15/00

[52] U.S. Cl. ..... 355/3 FU; 355/14 FU; 219/216; 29/132

[58] Field of Search ..... 355/3 FU, 14 FU; 430/98, 99, 124; 118/114, 116, 60; 219/216, 469; 29/132

[56] References Cited

U.S. PATENT DOCUMENTS

| | | | |
|---|---|---|---|
| 4,083,092 | 4/1978 | Imperial et al. | 29/132 |
| 4,257,699 | 3/1981 | Lentz | 355/3 FU |
| 4,363,862 | 12/1982 | Giorgini | 430/98 |
| 4,372,246 | 2/1983 | Azar et al. | 118/60 |
| 4,434,355 | 2/1984 | Inagaki et al. | 219/216 |
| 4,453,820 | 6/1984 | Suzuki | 355/3 FU X |
| 4,470,688 | 9/1984 | Inagaki et al. | 355/3 FU |

*Primary Examiner*—A. C. Prescott

*Attorney, Agent, or Firm*—Flehr, Hohbach, Test, Albritton & Herbert

[57] ABSTRACT

An electrophotographic copying apparatus in which heat fusible toner is transferred from its photoconductive drum to one surface of the ultimate copy sheet being made is disclosed herein along with a particular technique for fusing the transferred toner onto the sheet just mentioned. This fusing technique utilizes a fusing roller having an outermost circumferential surface and containing inwardly of this surface a material which undergoes a phase change at approximately the fusing temperature of the toner. The roller is heated to at least the toner fusing temperature in order to cause the material to undergo an endothermic phase change and thereby serve as a means of storing heat, and thereafter, the roller is caused to engage successive copy sheets carrying transferred toner sufficient to cause the heat from the roller to use the toner thereon.

12 Claims, 3 Drawing Figures

ELECTROPHOTOGRAPHIC COPYING APPARATUS INCLUDING SPECIFIC TONER FUSING ROLL AND ITS METHOD OF USE

The present invention relates generally to an electrophotographic copying apparatus in which heat fusible toner is transferred from its photoconductive drum to one surface of an ultimately formed copy sheet and more particularly to a specific means for and method of fusing the transferred toner onto the sheet.

The present invention is especially suitable for use in an electrophotographic apparatus of the typical type which is presently being used in the industry. This typical apparatus includes a rotatable drum having a photosensitive outer circumferential surface and means for rotating the drum in a controlled fashion so that its outer circumferential surface defines a fixed annular path of movement. The apparatus produces copies from a given master by first forming an electrostatic latent image corresponding to the particular information to be copied on the photosensitive outer circumferential surface of the drum. Thereafter, the latent image formed is developed by means of toner, specifically heat fusible toner, which is applied to the image bearing surface in a particular way. Finally, the applied toner is transferred from the drum to a blank sheet and thereafter fused thereon for transforming the sheet into a permanent copy.

In the apparatus just described, the last mentioned fusing step is carried out by means of an overall assembly including a fusing roll which is ultimately heated to a temperature at or slightly above the fusing temperature of the toner being used. Once the roll is so heated, copy sheets carrying transferred toner are successively brought into engagement with its outer surface in order to fuse the transferred toner.

While the fusing technique just described is generally satisfactory for its intended purpose, if the toner has a narrow temperature fusing range (from its minimum to its maximum), the temperature of the roll may not be sufficient to fuse the toner when a large number of successive copies are made. This is because each copy which is made tends to take a measurable amount of heat from the fusing roll, thereby causing the latter to drop in temperature. This can cause the temperature of the roll to drop below the minimum fusing temperature of the toner so as to cause the subsequent copies not to be entirely fused until the fuser roll is sufficiently heated to bring it back to the proper operating temperature for the given toner. Typically what happens in this case is that too much heat is pumped into the roll to that the latter over heats and possibly causes the toner to over fuse which, in turn, can cause premature failure of the fusing system. One way to reduce this problem is to use a toner having a wide temperature range so that the fusing roll can operate at all times within this range. However to provide such a toner is quite costly.

In view of the foregoing, it is the general object of the present invention to provide a way of minimizing if not entirely eliminating the fusing problem just described in an uncomplicated, reliable and yet economical way without having to resort to the use of a toner having a wide temperature range.

A more specific object of the present invention is to provide a particularly designed fuser roll which has the capability of storing and giving up heat as needed to ensure that sufficient heat (but not too much heat) is available for the fusing process during extended runs of the overall apparatus.

As indicated above, the present invention relates generally to an electrophotographic copying apparatus in which heat fusible toner is transferred from its photoconductive surface to a blank sheet for transforming the latter to the desired copy. As will be described in more detail hereinafter, this apparatus utilizes an assembly for fusing the transferred toner onto the sheet including a fuser roll designed in accordance with the present invention. This roll has an outermost circumferential surface and contains inwardly of this surface a material which undergoes a phase change at approximately the fusing temperature of the toner. The assembly also includes means supporting the copy sheet including transferred toner thereon for movement along a given path and means for supporting the roll for rotation such that its outermost surface engages the surface of the copy sheet containing the toner. The assembly also includes means for heating the roll to the fusing temperature of the toner in order to maintain its outer surface at the desired fusing temperature and, at the same time to cause the phase changeable material within the roll to undergo an endothermic phase change and thereby serve as a means for storing heat for use in fusing the toner as the outermost surface of the roll engages the copy sheet.

The fusing assembly just described briefly will be discussed in more detail hereinafter in conjunction with the drawing wherein.

Figure 2:
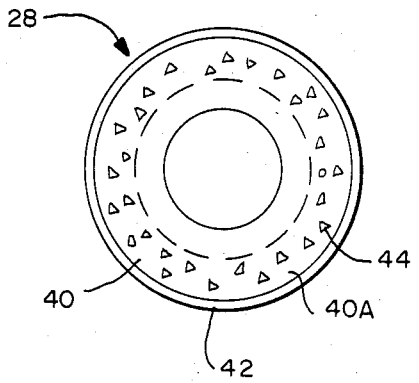
FIG. 2 is an enlarged cross-sectional view of the fuser roll illustrated in FIG. 1.
Figure 3:
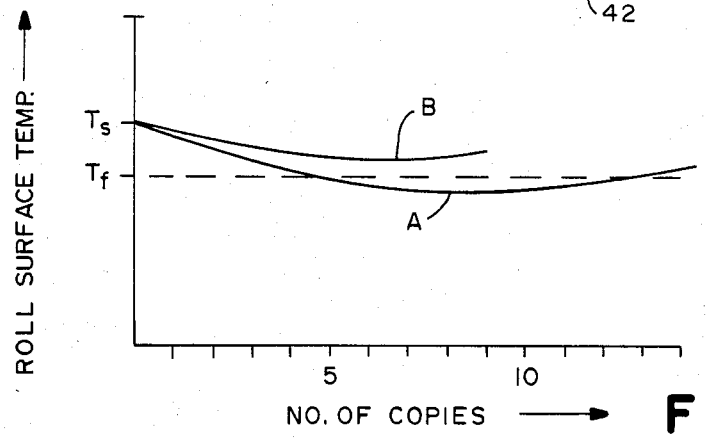

FIG. 3 graphically illustrates the way in which the fuser roll of FIG. 2 operates in accordance with the present invention.

Figure 1:
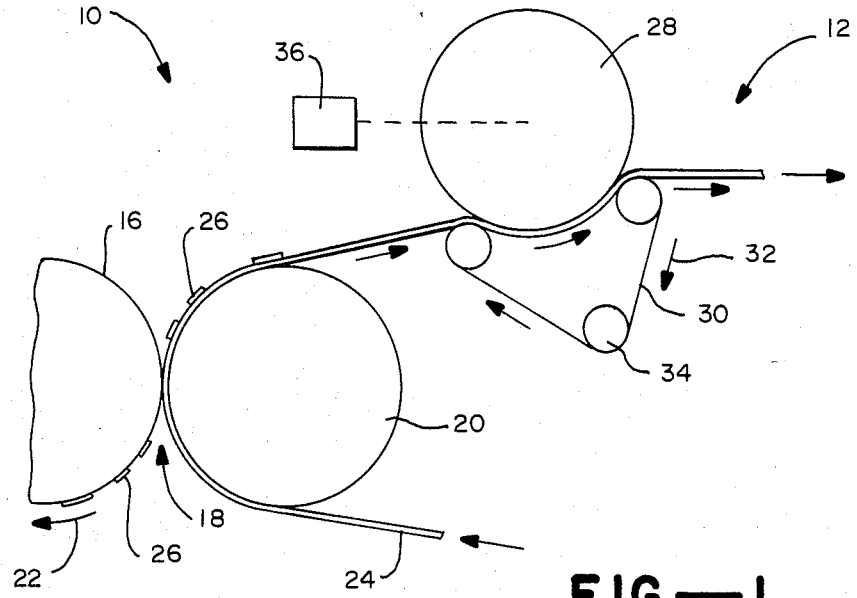
FIG. 1 is a diagrammatic illustration, in side elevational view, of a portion of an electrophotographic copying apparatus including specifically a toner fusing assembly which utilizes a fusing roll designed in accordance with the present invention.

Turning now to the drawing, attention is first directed to FIG. 1 which, as stated above, illustrates a portion of an electrophotographic apparatus including a toner fuser assembly utilizing a fuser roll designed in accordance with the present invention. The overall apparatus is generally indicated by the reference numeral 10 and the toner fusing assembly is shown at 12. The overall apparatus is also shown including a rotatable photoconductive drum 14 which is rotated by means not shown in a controllable manner so as to cause the drums outer surface 16 to move along a fixed annular path through a charging station, an exposure station, a developing station, and thereafter a transfer station. None of these stations are illustrated except for the transfer station which is shown in part at 18 including a transfer roll 20.

In actual operation, photoconductive drum 14 is caused to rotate in the direction of arrow 22 for causing a segment of its outer surface to move through the charging station and thereby charge to the desired level. Thereafter, the charged surface segment is moved through the exposure station where a like image of an original or master is projected onto the moving drum in order to discharge portions of its charged surface and form an electrostatic latent image conforming to the original. The electrostatic latent image thus formed is then moved through the developing station which contains a suitable arrangement including a supply of heat fusible toner charged to a polarity opposite that of the latent image and means for applying the toner to the drum. In this way, as the image bearing drum surface moves through the developing station, the charged toner is applied thereto causing it to develop the image, that is, form a visible powder image of the original.

Immediately after the latent image on the drum surface has been developed it is moved through transfer station 18 which includes the previously mentioned transfer roll 20 and the means not shown for carrying a continuous supply of blank paper 24 (or individual sheets) through a fixed path around the transfer roll and into engagement with the outer surface of the photoconductive drum such that the toner on the latter is transferred to the blank paper, thereby forming a copy of the original, as indicated by the transferred toner generally indicated at 26 in FIG. 1. Immediately after toner is transferred to paper 24 the latter is caused to move through fusing station 12 which, as stated above, serves to fuse the toner onto the paper, thereby providing permanent copies. A cutting machanism (not shown) is provided downstream from the fusing station in order to cut the copies to the appropriate size assuming the paper is provided in a continuous, uncut sheet. More often, individual pre-cut sheets are used, in which case a cutting mechanism is not necessary.

Turning now specifically to fusing assembly 12, the latter is shown including the previously recited fuser roll which is generally indicated at 28 and an endless transport belt 30 which is moved along a fixed, closed loop path indicated by arrows 32 by support rollers 34. The transport belt is designed to receive copy sheet or sheets 24 carrying toner 26 on front surfaces thereof and to bring these latter surfaces into pressure contact with the outer surface of fuser roll 28. Suitable means may be provided to lubricate the fuser roll with, for example, silicone oil or the like (not shown). At the same time, the fuser roll is supplied with sufficient heat from means generally indicated at 36 to fuse toner 26 to each sheet 24 during the time that transport belt 30 holds the copy sheet against the fuser roll. To this end, the fuser roll must be heated to a sufficiently high temperature so as to maintain its outer surface at or above the fusing temperature of the toner.

Turning now to FIG. 2, attention is specifically direct to the fuser roll 28 which, as stated above, is designed in accordance with the present invention. As seen in this Figure, the roll includes a central core 38 which, while not shown, includes the necessary heating coils or like means connected with means 36 for heating up the overall roll to its operating temperature. Surrounding this core is a somewhat resilient layer 40 of heat conductive material, for example, silicone rubber or a similar elastomer. Layer 40 is in turn surrounded by a somewhat more rigid outer layer 42, for example, a plastic or TEFLON (a trademark) coating. The resiliency of layer 40 provides give to the overall roll and outer layer 42 serves to protect layer 40.

The fuser roll described thus far may be identical to what is presently being used in the prior art, and thus, would not overcome the fusing problem discussed, as will be seen below. However, in accordance with the present invention, fuser roll 28 includes particulate material 44 dispersed uniformly throughout an outer circumferential segment 40A of layer 40 in close proximity to outer layer 42. Particulate material 44 is of a type which undergoes a phase change at the approximate fusing temperature of toner 26. More specifically, when the overall apparatus 10 is first turned on, the roll 28 is heated to the toner fusing temperature from room temperature. This, in turn causes the toner fusing temperature material 44 to undergo an endothermic phase change which serves as a means for storing heat for use in fusing toner on copy sheets 24 in the event a large run is made. As this fusing process actually takes place for a large number of rapidly made copies, heat is made available by the phase change material causing the latter to move back towards its initial phase.

In a preferred embodiment of the present invention, material 44 is of the type which changes from solid to liquid in the endothermic direction and liquid to solid in the exothermic direction. In other words, so long as the temperature of the fuser roll is below the toner fusing temperature, particulate material 44 is solid in form. Assuming the toner used has a fusing temperature of approximately 180° C., one type of phase change material 44 which can be used is a Tin-Lead-Bismuth alloy with a melting point of 176° C. and possessing a heat fusion of 60 calories per cubic centimeter. Obviously, this material may differ depending upon the fusing temperature of the toner being used. However, based on the teachings herein, the necessary phase change material can be readily selected and, as will be seen, the toner selected can be one having a relatively narrow fusing temperature range.

Having described overall fusing assembly 12 and particularly fuser roll 28, the way in which this fuser roll overcomes the previously described fusing problem is graphically illustrated in FIG. 3. Specifically, a first curve A is shown and corresponds to the temperature of the outer surface of roller 28, absent particulate material 44, as ten successive copies are made on apparatus 10, one right after another. Curve B is similar to curve A but corresponds to the temperature of the fuser roll's outer surface when the latter includes particulate material 44. The temperature $T_s$ corresponds to the temperature of the fuser roll (its outer surface) at the time the apparatus is ready to make its first copy and after the latter has been endothermically changed from a solid to a liquid phase. The temperature $T_f$ corresponds to the fusing temperature of the toner. Note that the outer surface of the fuser roll which does not include particulate material 44 (curve A) drops below the critical temperature value (the toner fusing temperature $T_f$) at some point within the first ten copies before the overall roll is provided with sufficient heat to raise its outer surface to the necessary temperature. On the other hand, the temperature of the roll's outer surface is stabilized by the inclusion of material 44 as exemplified in curve B. As seen there, the temperature remains above the critical temperature $T_f$ at all times. This is because the material 44 gives up heat to the roll's surface during the copying process. In the same way it takes up heat being pumped into the roll immediately after the last copy is made so that the roll's surface does not overheat.

It is to be understood that the graphic illustration just described it is intended for descriptive purposes only to reflect how the present invention overcomes the problems of the prior art. This graphic illustration is not intended to represent actual data.

What is claimed is:

1. In an electrophotographic copying apparatus in which heat fusible toner is transferred from its photoconductive drum to one surface of the ultimate copy sheet, an assembly for fusing the transferred toner onto said sheet, said assembly comprising means supporting said copy sheet for movement along a given path, a fusing roll having an outermost circumferential surface, and containing inwardly of said outermost surface a material which undergoes a phase change at approximately the fusing temperature of said toner, means supporting said roll for rotation such that its outermost surface engages the surface of said copy sheet carrying said toner, and means for heating said roll to at least said fusing temperature in order to cause said material to undergo an endothermic phase change and thereby serve as a means for storing heat for use in fusing said toner as the outermost surface of said roll engages said copy sheet.

2. An assembly according to claim 1 wherein said material is of the type which changes from solid to liquid in the endothermic direction and liquid to solid in the exothermic direction.

3. An assembly according to claim 2 wherein said material is contained within said roll in particulate form, the particulate material being dispersed throughout a circumferential layer of said roll radially inward of its outermost surface.

4. An assembly according to claim 3 wherein said circumferential layer is an elastomer.

5. An assembly according to claim 3 wherein said particulate material is a Tin-Lead-Bismuth alloy with a melting point of 176° C. and possessing a heat fusion of 60 calories per cubic centimeter.

6. In an electrophotographic copying apparatus in which heat fusible toner is transferred from its photoconductive drum to one surface of the ultimate copy sheet and in which an assembly is used to fuse the transferred toner onto said sheet, a fusing roller forming part of said assembly, said fusing roll comprising a main body having an outermost surface and containing inwardly of said outermost surface a material which undergoes a phase change at approximately the fusing temperature of said toner, whereby when said roll is heated to said fusing temperature in order to fuse said toner onto said sheet said material is caused to undergo an endothermic phase change and thereby serve as a means for storing heat for use in the fusing process.

7. A fusing roll according to claim 6 wherein said material is of the type which changes from solid to liquid in the endothermic direction and liquid to solid in the exothermic direction.

8. A fusing roll according to claim 7 wherein said material is contained within said roll in particulate form, the particulate material being dispersed throughout a circumferential layer of said roller radially inward of its outermost surface.

9. A fusing roll according to claim 8 wherein said circumferential layer is an elastomer.

10. A fusing roll according to claim 9 wherein said particulate material is a Tin-Lead-Bismuth alloy with a melting point of 176° C. and possessing a heat fusion of 60 calories per cubic centimeter.

11. In an electrophotographic copying apparatus in which heat fusible toner is transferred from its photoconductive drum to one surface of the ultimate copy sheet being made, a method of fusing the transferred toner onto said sheet, said method comprising the step of supporting said copy sheet for movement along a given path, providing a fusing roll which has an outermost circumferential surface and which contains inwardly of said surface a material that undergoes a phase change at approximately the fusing temperature of said toner, heating said roll to at least said fusing temperature in order to cause said material to undergo an endothermic phase change and thereby serve as a means of storing heat for use in fusing said toner, and transferring heat from said roll to said copy sheet in order to fuse the toner thereon.

12. A method according to claim 11 wherein said material is of the type which changes from solid to liquid in the endothermic direction and liquid to solid in the exothermic direction.

* * * * *